US007513268B2

(12) United States Patent
Doman

(10) Patent No.: US 7,513,268 B2
(45) Date of Patent: Apr. 7, 2009

(54) KRUTCH KLIP AND KUP

(76) Inventor: Earl Arthur Doman, 2 Progress Way, Woodburn, OR (US) 97071

( * ) Notice: Subject to any disclaimer, the term of this patent is extended or adjusted under 35 U.S.C. 154(b) by 0 days.

(21) Appl. No.: 11/351,205

(22) Filed: Feb. 10, 2006

(65) Prior Publication Data

US 2007/0186965 A1 Aug. 16, 2007

(51) Int. Cl.
*A45B 3/00* (2006.01)

(52) U.S. Cl. ..... 135/66

(58) Field of Classification Search ..... 135/66, 135/68; 248/175, 176.1, 309.1
See application file for complete search history.

(56) References Cited

U.S. PATENT DOCUMENTS 2,750,951 A * 6/1956 Barnwell ..... 135/68
3,429,541 A * 2/1969 Herman ..... 248/302
3,616,977 A * 11/1971 Zurmuhlen ..... 224/435
3,985,148 A * 10/1976 Cadman ..... 135/66
4,146,045 A * 3/1979 Grant ..... 135/66
5,056,545 A * 10/1991 Spaeth ..... 135/66
5,101,845 A * 4/1992 Kravetz ..... 135/66
5,647,519 A * 7/1997 Brennan ..... 224/407
5,803,327 A * 9/1998 Nipper et al. ..... 224/407
6,045,107 A * 4/2000 Carlson ..... 248/445

* cited by examiner

*Primary Examiner*—David Dunn
*Assistant Examiner*—Noah Chandler Hawk

(57) ABSTRACT

This invention is a steel tempered wire approximately 3/16" in diameter bent to form a clip to hold papers, files, or any item normally carried by hand. The clip has enough tension to hold the items snugly against a crutch so the individual can use both hands to navigate on the crutch. It is positioned under the arm just above the crutch handle. It can be on the inside or outside position, but normally would be used on the outside. The design fits a normal crutch without any crutch alteration. The steel wire is also bent to hold various types of drink containers. It is positioned at the lower part of the crutch where the two sides come together. The wire could be a molded plastic container.

1 Claim, 3 Drawing Sheets

KRUTCH KLIP AND KUP

CROSS REFERENCE TO RELATED APPLICATIONS not applicable

STATEMENT REGARDING FEDERAL SPONSORED R & D not applicable

REFERENCE TO SEQUENCE LISTING not applicable

BACKGROUND OF THE INVENTIONS

The applicant spent two years on crutches. During that time, to be semi-active, the need to carry papers, files, drinks, etc. was constant. A clip and cup created for his personal crutches were so effective, that it was felt others may also find them useful. Especially since the design was so simple and adapted to the structure of the standard crutch, the cost would not be prohibitive. The field of endeavor would pertain to all individuals needing ambulatory assistance through medical equipment. There are no known references to specific documents related to this invention or prior art problems.

BRIEF SUMMARY OF THE INVENTIONS

This patent application is for a simple mechanism called a "Krutch Klip" and Krutch Kup, designed to hold items normally carried by hand. A person using crutches, because of handicap or injury, is required to use both hands to manipulate the crutches and frequently has need to carry an item from point A to point B.

The "Krutch Klip" is a steel wire bent to produce a springing action (similar to a mouse trap spring). The design allows the spring to be firmly attached to either crutch at the hand bar.

The spring protrudes up towards the arm pit and is simply pried open by hand, placing the cargo between the crutch and the spring. When the spring is released, the cargo is held firmly against the crutch until arrival at destination. A small section of rubber will be attached to the top section of the clip, just opposite the crutch frame, on both sides, to eliminate slippage of the cargo out of the clip. Depending upon user's preference, the clip may be used on the inside or outside by simply turning the crutch.

The "Krutch Kup" is a plastic mold or a spring shape to hold drink containers of the most common size.

DETAILED DESCRIPTION OF THE PREFERRED EMBODIMENT

Figure 1:
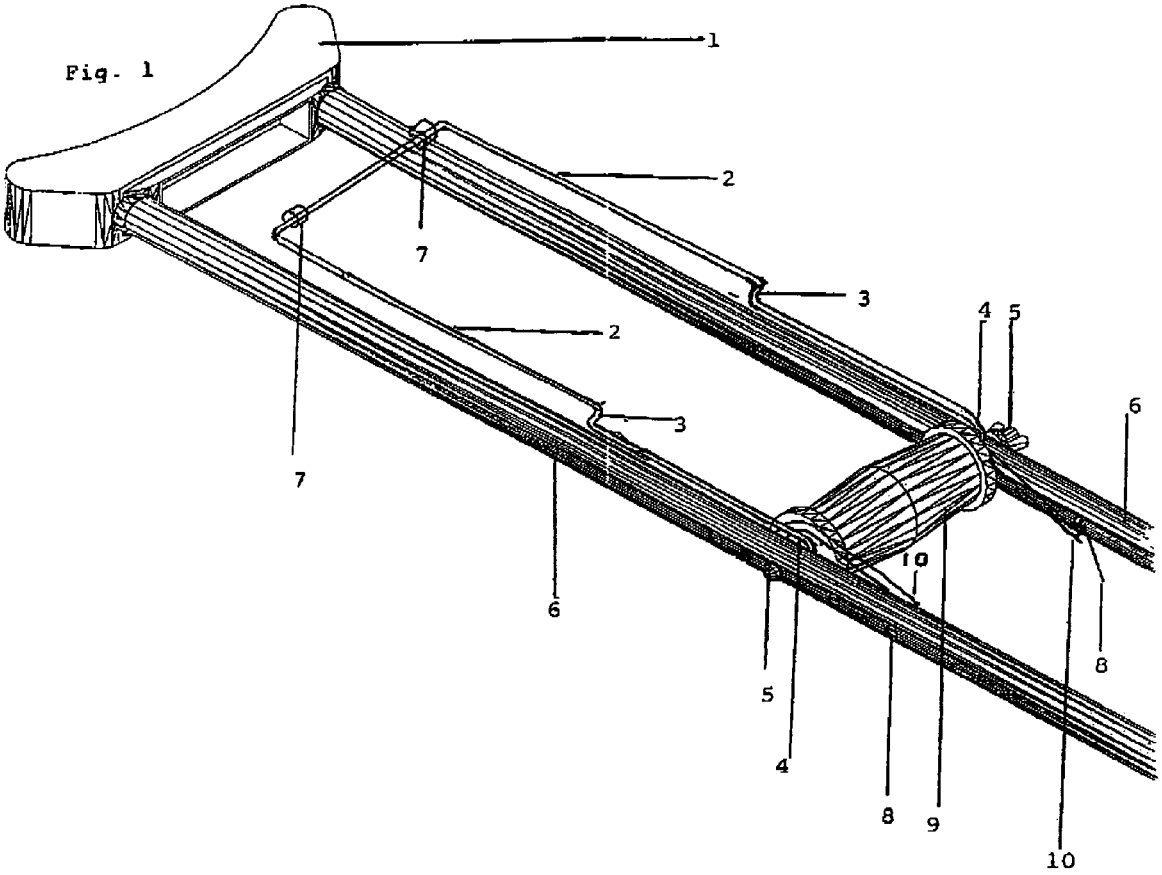
FIG. 1 is a plan view of the top portion of a crutch having the crutch clip of the present invention.
Figure 3:
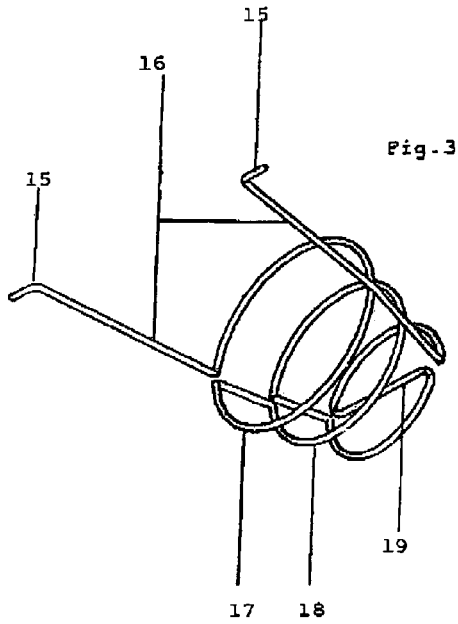
FIG. 3 is a plan view of an alternate embodiment of the cup holder of the present invention
Figure 2:
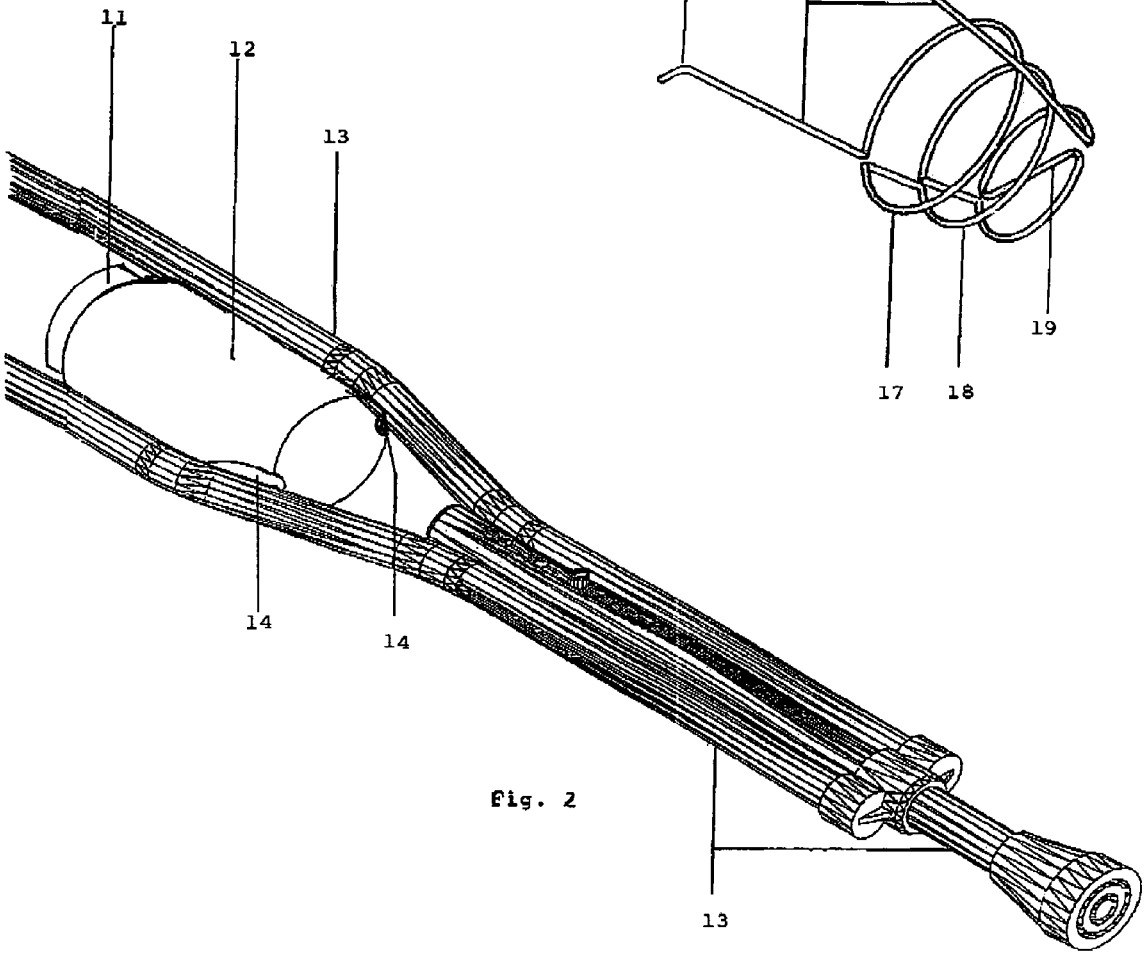
FIG. 2 is a plan view of the bottom portion of a crutch having the cup holder of the present invention.
Figure 4:
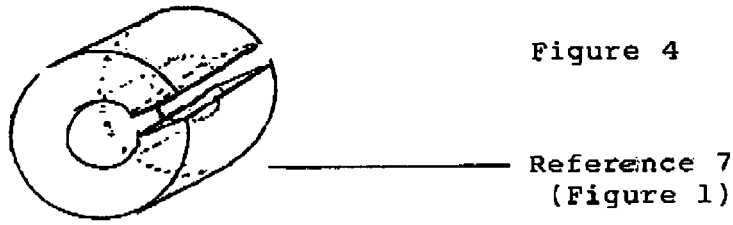
FIG. 4 is a detailed view of the round rubber tube portion of the crutch clip of the present invention.
Figure 5:
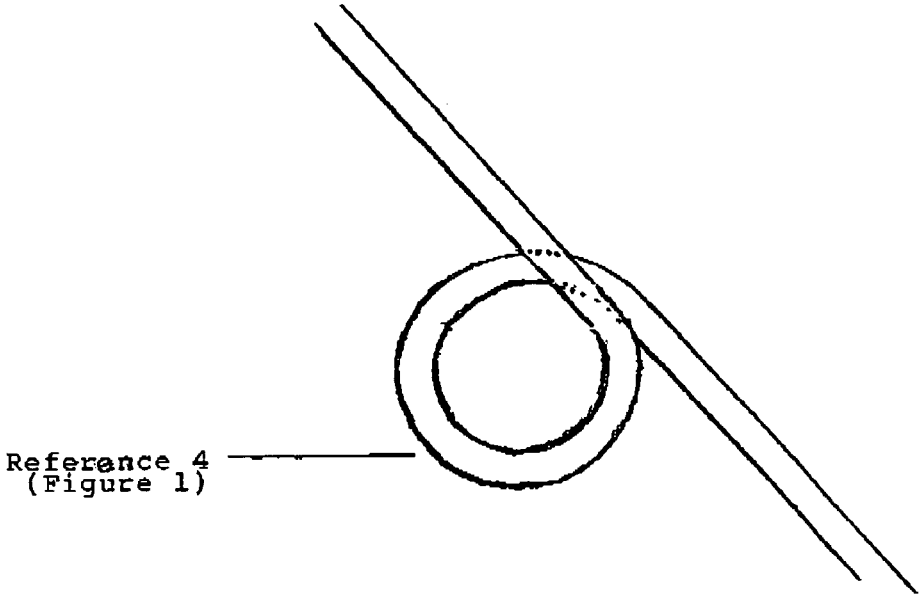
FIG. 5 is a detailed view of the bent circle portion of the crutch clip of the present invention.

Referring initially to the numbers on FIGS. 1, 2 and 3, the present inventions are a crutch clip (2), as shown on FIG. 1 and a cup holder (12) as shown on FIGS. 2 & 3. The top half of a crutch (1) (6) & (9) and the bottom half of a crutch (13) are not a part of the invention, but displayed to show the intended use of the invention A clip (2) is a 3/16" stainless steel tempered wire bent (2) (3) (4) (10) to fit the shape of a crutch (1) (6) (13). The flexibility and clamping tension strength is produced by a bent circle (4) (FIG. 5) the size of the circumference at each end of a crutch handle (9) fitting between a handle (9) and a crutch frame (6). The fulcrum and stability is produced by tightening the crutch handle (9) bolt (5) slid through a hole (8) in the frame (6) and handle (9) at arms length from the top of a crutch (1). Each wire (2) end (10) is bent ninety degrees toward the crutch frame (6) and is inserted in a hole (8) in the frame (6) to provide stability in the clamping tension of a clip (2). The pressure point to hold the cargo is a round rubber tube (7) (FIG. 4) attached to the wire (2) positioned directly over each frame (6) at the top of the clip (7) (FIG. 4). A platform to help hold the cargo in place is two half inch bends (3) in the wire (2) directly opposite on both sides six inches above the handle (9). As shown in FIG. 2, a plastic molded cup holder (12) has an indentation (14) on opposite sides at the bottom of the cup holder (14) molded to fit the shape of the lower part of a frame (13). A cup holder (12) is inserted downward until the indentations (14) are firmly seated in a frame (14). A desired cargo or drink (11) is inserted downward in the cup holder (12). This formation allows no movement once in place. A cheaper and more flexible alternative as shown in FIG. 3 is a 3/16" stainless steel tempered wire (16) bent in a fashion to create a floor (19) for any drink container (11). The second ring (18) one and a half inches up from the floor (19) is two and five eighths inches in diameter. A top ring three and on eighth inches in diameter (17) is slightly larger than the second ring (18) to allow sloping side containers to fit snugly in a cup holder (12). A wire cup holder's (FIG. 3) attachment to a crutch (13) will be holes similar to #8 of FIG. 1 drilled on opposite sides of a frame (13) at a level to allow a cup holder to swing freely from side to side maintaining a level balance without the bottom of a wire cup holder's frame (12) striking any part of a crutch frame (13). The wire (16) is bent (15) at right angles to insert in the hole.

I claim:

1. A clip comprising:

A stainless steel three sixteenth inch wire, bent downward twice at right angles equidistant from the middle of the wire length to leave a top section two inches wider than the width of a crutch frame to become a top of the clip, having two downward protruding wires with second right angles bends forty-five degrees opposite from the first bends ten inches down from the top of the clip on both downward protruding wires in the same direction as third right angle bends in both downward protruding wires one inch from the second bends to cause each downward protruding wire to continue in the same direction as the wires after the first bends which leaves a shelf in each of the downward protruding wires of the clip for cargo, with complete circle bends having a diameter of one and one fourth inches and formed in the same direction and angle as, and six inches down from, the third bends in both downward protruding wires, the circular bends developing a spring like tension capacity when a crutch handle bolt is inserted through the wire bend and a handle of the crutch and tightened making a fulcrum for the clip's lever action, with outward right angle bends in opposite directions on each downward protruding wire one half inch from the ends of the wires which, when inserted in a drill hole in a crutch frame provides a fixed attachment on both sides of the crutch frame necessary to hold the clip against the crutch frame, with two rubber tubes one inch in length and cut length wise to enable slipping each rubber tube over the wire at the top section of the clip on each side at a position where the rubber will touch the crutch frame directly and enhance the clip's capacity to hold cargo firmly without slipping.

* * * * *